US012317952B2

(12) United States Patent
Campos, II et al.

(10) Patent No.: US 12,317,952 B2
(45) **Date of Patent: *Jun. 3, 2025**

(54) BLADDER AND SOLE STRUCTURE FOR ARTICLE OF FOOTWEAR

(71) Applicant: NIKE, Inc., Beaverton, OR (US)

(72) Inventors: Fidencio Campos, II, Dallas, OR (US); Tee L. Wan, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/306,666

(22) Filed: Apr. 25, 2023

(65) Prior Publication Data

US 2024/0090618 A1 Mar. 21, 2024

Related U.S. Application Data

(63) Continuation of application No. 16/950,798, filed on Nov. 17, 2020, now Pat. No. 11,666,118.

(Continued)

(51) Int. Cl.

| | |
|---|---|
| ***A43B 13/20*** | (2006.01) |
| ***A43B 1/00*** | (2006.01) |
| ***A43B 13/18*** | (2006.01) |

(52) U.S. Cl.

CPC ..... *A43B 13/20* (2013.01); *A43B 1/0072* (2013.01); *A43B 13/186* (2013.01)

(58) Field of Classification Search

CPC ..... A43B 13/20; A43B 13/186; A43B 13/189; A43B 13/181

(Continued)

(56) References Cited

U.S. PATENT DOCUMENTS

| | | | |
|---|---|---|---|
| 5,113,599 | A | 5/1992 | Cohen et al. |
| 5,131,174 | A | 7/1992 | Drew et al. |

(Continued)

FOREIGN PATENT DOCUMENTS

| | | | |
|---|---|---|---|
| JP | 4272674 | B2 | 6/2009 |
| KR | 100669583 | B1 | 1/2007 |

OTHER PUBLICATIONS

European Patent Office (ISA), International Search Report and Written Opinion for PCT/US2020/061029, mailed Feb. 24, 2021.

(Continued)

*Primary Examiner* — Khoa D Huynh
*Assistant Examiner* — Haley A Smith
(74) *Attorney, Agent, or Firm* — Honigman LLP; Matthew H. Szalach; Jonathan P. O'Brien

(57) ABSTRACT

A bladder for an article of footwear includes a support chamber and an expansion chamber. The support chamber has a top wall, a bottom wall, and a peripheral wall extending between the top wall and the bottom wall and defining a peripheral profile of the support chamber. The expansion chamber extends from the peripheral wall at a first end of the bladder. In some examples, the peripheral wall defines a first end of the support chamber having one or more lobes extending from the top wall to the bottom wall. The one or more lobes may include a first lobe disposed adjacent to a first side of the support chamber and a second lobe disposed adjacent to a second side of the support chamber. The expansion chamber may be disposed between the first lobe and the second lobe at the first end of the support chamber.

16 Claims, 7 Drawing Sheets

Related U.S. Application Data

(60) Provisional application No. 62/937,585, filed on Nov. 19, 2019.

(58) Field of Classification Search
USPC ..... 36/29; D2/961
See application file for complete search history.

(56) References Cited

U.S. PATENT DOCUMENTS

| | | | | |
|---|---|---|---|---|
| 5,704,137 | A * | 1/1998 | Dean | A43B 17/03 36/71 |
| 6,192,606 | B1 * | 2/2001 | Pavone | A43B 13/20 36/35 B |
| 6,453,577 | B1 | 9/2002 | Litchfield et al. | |
| 6,457,262 | B1 * | 10/2002 | Swigart | A43B 13/206 36/35 B |
| 6,863,958 | B2 | 3/2005 | Wang | |
| D549,433 | S | 8/2007 | Schindler et al. | |
| 7,707,744 | B2 | 5/2010 | Schindler et al. | |
| 7,810,255 | B2 * | 10/2010 | Schindler | A43B 3/0036 36/35 B |
| 8,042,286 | B2 | 10/2011 | Schindler et al. | |
| 9,609,913 | B2 | 4/2017 | Bates et al. | |
| 2002/0053146 | A1 * | 5/2002 | Swigart | A43B 13/206 36/35 B |
| 2003/0072909 | A1 | 4/2003 | Hung | |
| 2003/0208930 | A1 * | 11/2003 | Swigart | A43B 7/144 36/29 |
| 2004/0025375 | A1 | 2/2004 | Turner et al. | |
| 2006/0086003 | A1 | 4/2006 | Tseng | |
| 2006/0248750 | A1 | 11/2006 | Rosenberg | |
| 2007/0063368 | A1 | 3/2007 | Schindler | |
| 2007/0119075 | A1 | 5/2007 | Schindler et al. | |
| 2008/0184595 | A1 * | 8/2008 | Schindler | A43B 3/0036 36/35 B |
| 2009/0288313 | A1 | 11/2009 | Rapaport et al. | |
| 2011/0088281 | A1 * | 4/2011 | Farina | A43B 13/20 36/29 |
| 2012/0216943 | A1 | 8/2012 | Rapaport et al. | |
| 2014/0173937 | A1 | 6/2014 | Smith et al. | |
| 2017/0266938 | A1 | 9/2017 | Hensley et al. | |
| 2020/0305551 | A1 | 10/2020 | Campos, II et al. | |

OTHER PUBLICATIONS

USPTO, Final Office Action for U.S. Appl. No. 16/950,798, mailed Nov. 14, 2022.
USPTO, Non-Final Office Action for U.S. Appl. No. 16/950,798, mailed Jun. 3, 2022.
USPTO, Final Office Action for U.S. Appl. No. 16/950,798, mailed Mar. 17, 2022.
USPTO, Non-Final Office Action for U.S. Appl. No. 16/950,798, mailed Nov. 15, 2021.
European Patent Office, Communication pursuant to Article 94(3) EPC for EP App. No. 20824779.1, mailed May 3, 2024.
Korea Intellectual Property Office, Notice of Final Rejection for KR App. No. 10-2022-7019966, mailed Sep. 27, 2024.

* cited by examiner

BLADDER AND SOLE STRUCTURE FOR ARTICLE OF FOOTWEAR

CROSS REFERENCE TO RELATED APPLICATION

This application is a continuation of U.S. application Ser. No. 16/950,798, filed Nov. 17, 2020, which claims priority to U.S. Provisional Application No. 62/937,585, filed Nov. 19, 2019, the contents of which are hereby incorporated by reference in their entirety.

FIELD

The present disclosure relates generally to sole structures for articles of footwear, and more particularly, to sole structures incorporating a bladder.

BACKGROUND

This section provides background information related to the present disclosure, which is not necessarily prior art.

Articles of footwear conventionally include an upper and a sole structure. The upper may be formed from any suitable material(s) to receive, secure, and support a foot on the sole structure. The upper may cooperate with laces, straps, or other fasteners to adjust the fit of the upper around the foot. A bottom portion of the upper, proximate to a bottom surface of the foot, attaches to the sole structure.

Sole structures generally include a layered arrangement extending between a ground surface and the upper. One layer of the sole structure includes an outsole that provides abrasion-resistance and traction with the ground surface. The outsole may be formed from rubber or other materials that impart durability and wear-resistance, as well as enhance traction with the ground surface. Another layer of the sole structure includes a midsole disposed between the outsole and the upper. The midsole provides cushioning for the foot and may be partially formed from a polymer foam material that compresses resiliently under an applied load to cushion the foot by attenuating ground-reaction forces. The midsole may additionally or alternatively incorporate a fluid-filled bladder to increase durability of the sole structure, as well as to provide cushioning to the foot by compressing resiliently under an applied load to attenuate ground-reaction forces. Sole structures may also include a comfort-enhancing insole or a sockliner located within a void proximate to the bottom portion of the upper and a strobel attached to the upper and disposed between the midsole and the insole or sockliner.

Midsoles employing bladders typically include a bladder formed from two barrier layers of polymer material that are sealed or bonded together. The bladders may contain air, and may incorporate tensile members within the bladder to retain the shape of the bladder when compressed resiliently under applied loads, such as during athletic movements. Generally, bladders are designed with an emphasis on balancing support for the foot and cushioning characteristics that relate to responsiveness as the bladder resiliently compresses under an applied load

DRAWINGS

The drawings described herein are for illustrative purposes only of selected configurations and are not intended to limit the scope of the present disclosure.

Corresponding reference numerals indicate corresponding parts throughout the drawings.

DETAILED DESCRIPTION

Figure 1:
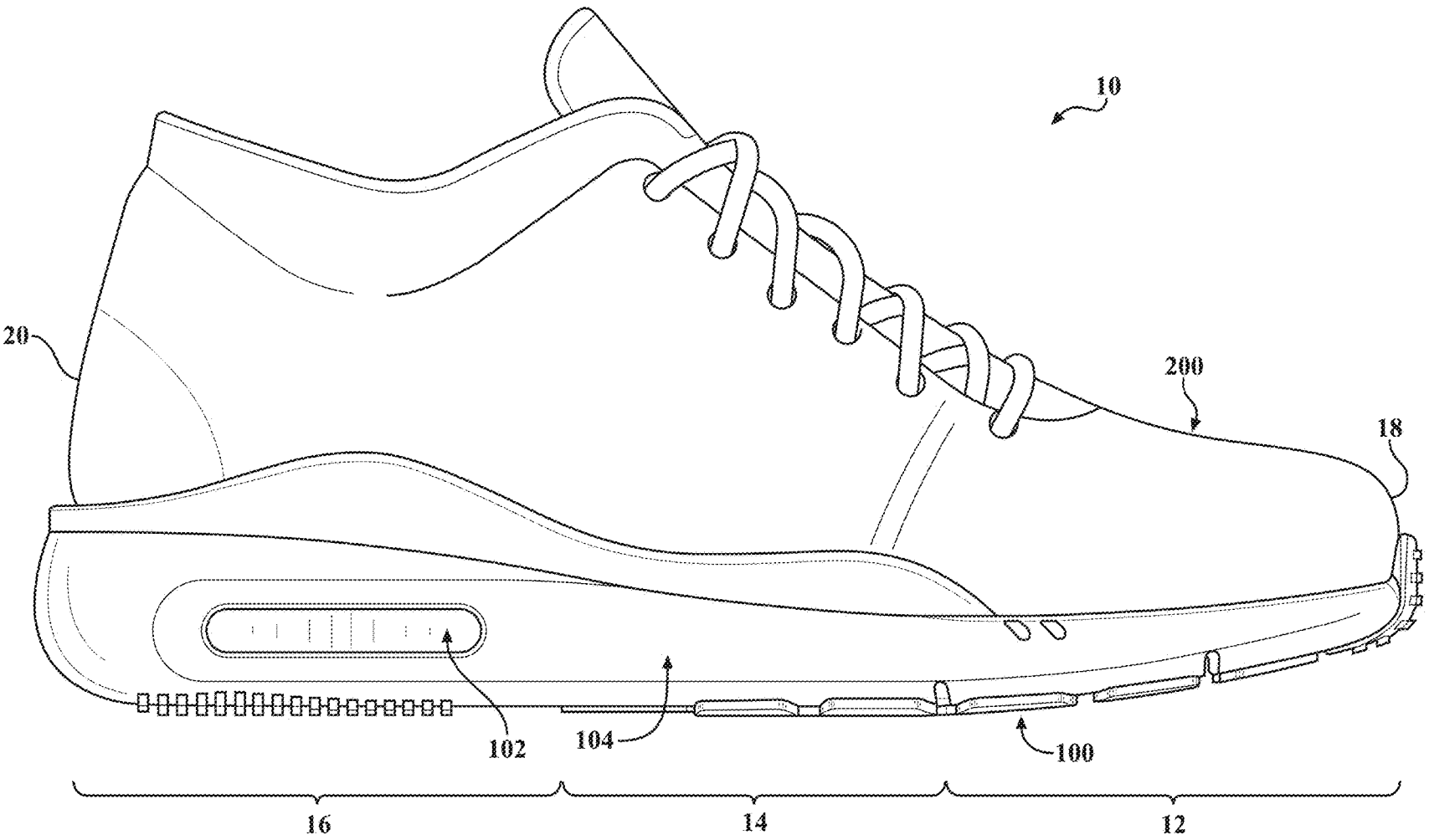
FIG. 1 is a side perspective view of an article of footwear in accordance with principles of the present disclosure.

Example configurations will now be described more fully with reference to the accompanying drawings. Example configurations are provided so that this disclosure will be thorough, and will fully convey the scope of the disclosure to those of ordinary skill in the art. Specific details are set forth such as examples of specific components, devices, and methods, to provide a thorough understanding of configurations of the present disclosure. It will be apparent to those of ordinary skill in the art that specific details need not be employed, that example configurations may be embodied in many different forms, and that the specific details and the example configurations should not be construed to limit the scope of the disclosure.

The terminology used herein is for the purpose of describing particular exemplary configurations only and is not intended to be limiting. As used herein, the singular articles "a," "an," and "the" may be intended to include the plural forms as well, unless the context clearly indicates otherwise. The terms "comprises," "comprising," "including," and "having," are inclusive and therefore specify the presence of features, steps, operations, elements, and/or components, but do not preclude the presence or addition of one or more other features, steps, operations, elements, components, and/or groups thereof. The method steps, processes, and operations described herein are not to be construed as necessarily requiring their performance in the particular order discussed or illustrated, unless specifically identified as an order of performance. Additional or alternative steps may be employed.

When an element or layer is referred to as being "on," "engaged to," "connected to," "attached to," or "coupled to" another element or layer, it may be directly on, engaged, connected, attached, or coupled to the other element or layer, or intervening elements or layers may be present. In contrast, when an element is referred to as being "directly on," "directly engaged to," "directly connected to," "directly attached to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

The terms first, second, third, etc. may be used herein to describe various elements, components, regions, layers and/or sections. These elements, components, regions, layers and/or sections should not be limited by these terms. These terms may be only used to distinguish one element, component, region, layer or section from another region, layer or section. Terms such as "first," "second," and other numerical terms do not imply a sequence or order unless clearly indicated by the context. Thus, a first element, component, region, layer or section discussed below could be termed a second element, component, region, layer or section without departing from the teachings of the example configurations.

In some aspects of the disclosure, a bladder for an article of footwear is provided. The bladder includes a support chamber having a top wall, a bottom wall, and a peripheral wall extending between the top wall and the bottom wall and defining a peripheral profile of the support chamber. The bladder further includes an expansion chamber extending from the peripheral wall at a first end of the bladder.

Aspects of the disclosure may include one or more of the following optional features.

In some examples, the peripheral wall defines an anterior end of the support chamber having one or more lobes extending from the top wall to the bottom wall. In some implementations, the one or more lobes includes a first lobe disposed adjacent to a first side of the support chamber and a second lobe disposed adjacent to a second side of the support chamber, the first side being disposed on an opposite side of the support chamber than the second side. In some configurations, the peripheral wall defines a recess disposed between the first lobe and the second lobe.

In some examples, the peripheral wall defines a posterior end of the support chamber having one or more lobes extending from the top wall to the bottom wall. The one or more lobes may include a third lobe disposed adjacent to a first side of the support chamber and a fourth lobe disposed adjacent to a second side of the support chamber, the first side being disposed on an opposite side of the support chamber than the second side. Here, the expansion chamber may be disposed between the third lobe and the fourth lobe.

In some implementations, the expansion chamber includes a flat upper wall and a curved lower wall. Optionally, the lower wall projects outwardly from the peripheral wall of the support chamber between the top wall and the bottom wall. In some examples, the lower wall is cupped and the top wall is planar.

In some implementations, the support chamber and the expansion chamber cooperate to define an interior void of the bladder. Optionally, the interior void is filled with a compressible fluid at atmospheric pressure.

In some configurations, the bladder further includes one or more valves in fluid communication with the support chamber.

In some implementations, the top wall defines a recess and the bottom wall is planar.

In some examples, a thickness of the expansion chamber tapers along at least one of a width and a length of the expansion chamber.

In another aspect of the disclosure, a bladder for an article of footwear is provided. The bladder includes a support chamber defining a first portion of an interior void. The support chamber includes a first lobe and a second lobe disposed at a first end. The bladder further includes an expansion chamber disposed between the first lobe and the second lobe at the first end of the support chamber. The expansion chamber defines a second portion of the interior void, and is in fluid communication with the first portion. The interior void contains a compressible fluid at a first pressure.

Aspects of the disclosure may include one or more of the following optional features.

In some examples, the first pressure is atmospheric pressure.

In some implementations, each of the first lobe and the second lobe protrudes from the first end.

In some configurations, each of the first lobe and the second lobe is rounded.

In some examples, each of the first lobe and the second lobe is cylindrical.

In some implementations, the first end of the support chamber includes a curved central portion disposed between the first lobe and the second lobe. Here, the central portion may be cylindrical. In some examples, the expansion chamber protrudes from the central portion.

In some implementations, the support chamber includes a planar bottom wall and a top wall disposed on an opposite side of the bladder from the bottom wall, the top wall defining a recess.

In some configurations, the support chamber includes a third lobe and a fourth lobe disposed at a second end of the support chamber. Optionally, each of the third lobe and the fourth lobe protrudes from the first end. In some examples, each of the third lobe and the fourth lobe is rounded. In some implementations, each of the third lobe and the fourth lobe is cylindrical.

In some implementations, the first end of the support chamber includes a curved central portion disposed between the first lobe and the second lobe.

In some examples, the bladder includes one or more valves in fluid communication with the support chamber.

In another aspect of the disclosure, a sole structure for an article of footwear including the bladder of any of the preceding paragraphs is provided. In some examples, the sole structure includes a cushioning element extending from a first end to a second end and including (i) a top surface, (ii) a bottom surface formed on an opposite side of the cushioning element from the top surface, and (iii) a recess formed in the top surface and configured to receive the bladder therein.

In some implementations, the bladder and the top surface of the cushioning element cooperate to define a footbed of the sole structure.

Optionally, the cushioning element includes a foam material.

In another aspect of the disclosure, an article of footwear includes the sole structure described above.

Figure 2:
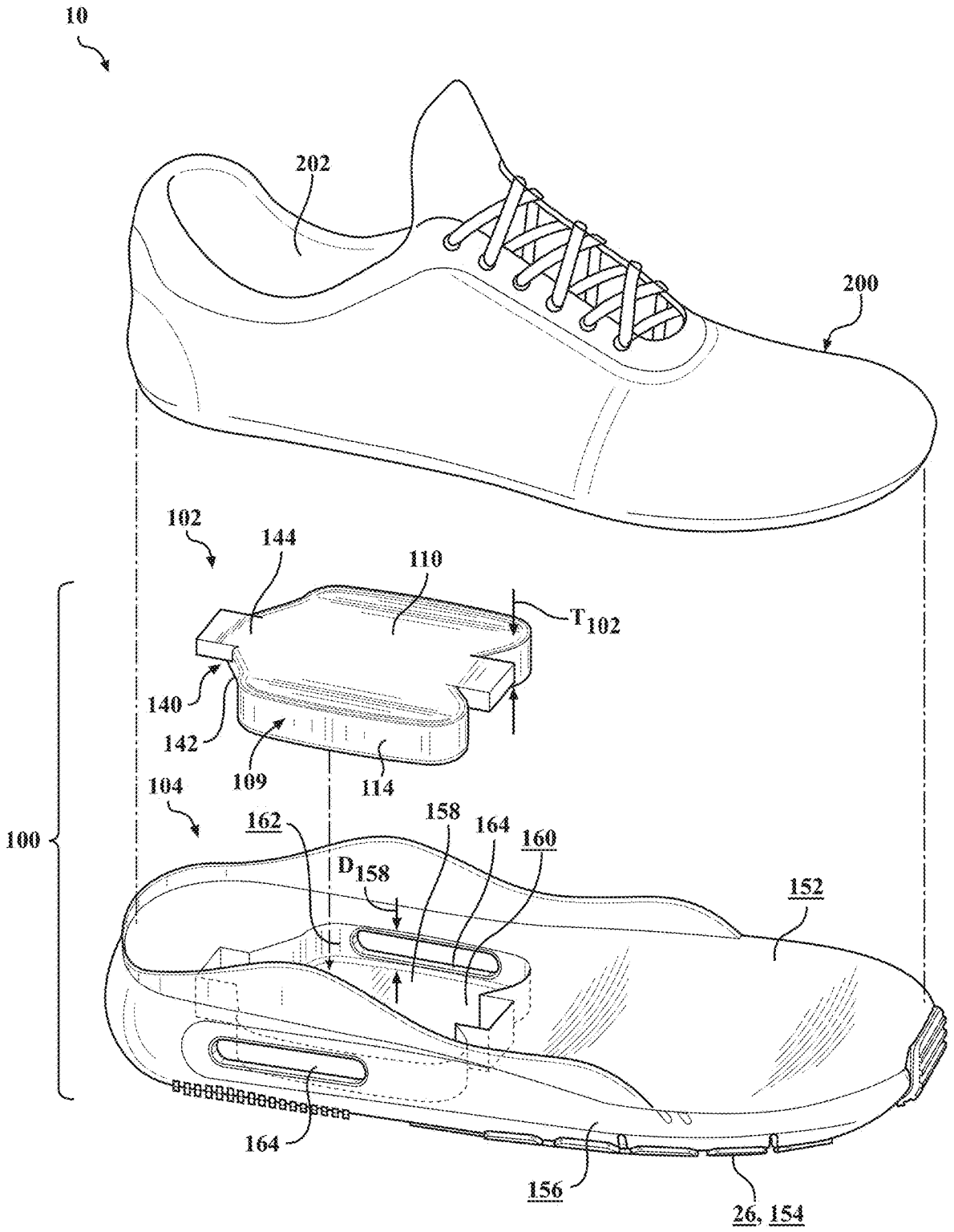
FIG. 2 is an exploded view of the article of footwear of FIG. 1, showing an article of footwear having an upper and a sole structure arranged in a layered configuration.
Figure 3:
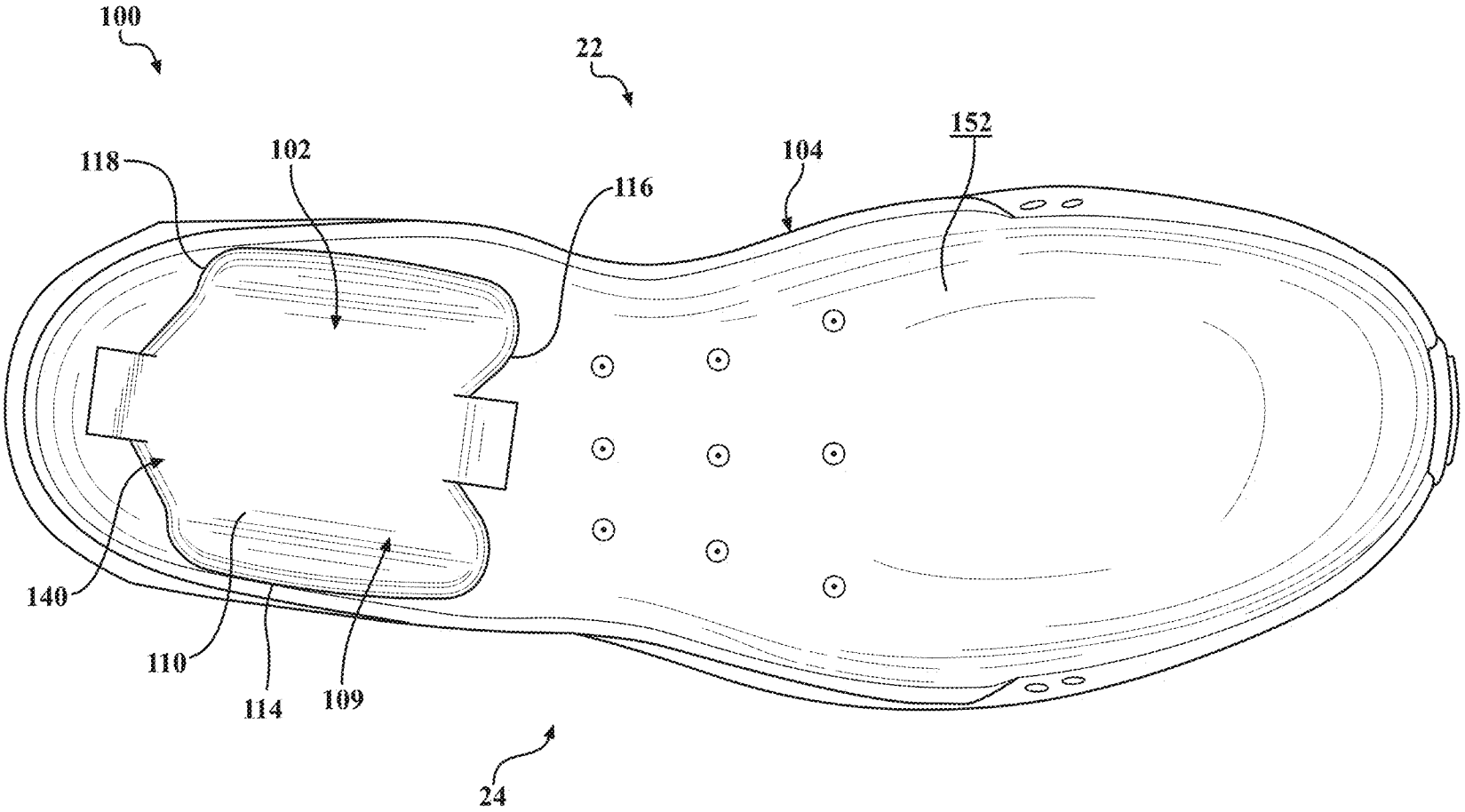
FIG. 3 is a top plan view of the sole structure of the article of footwear of FIG. 1.
Figure 4:
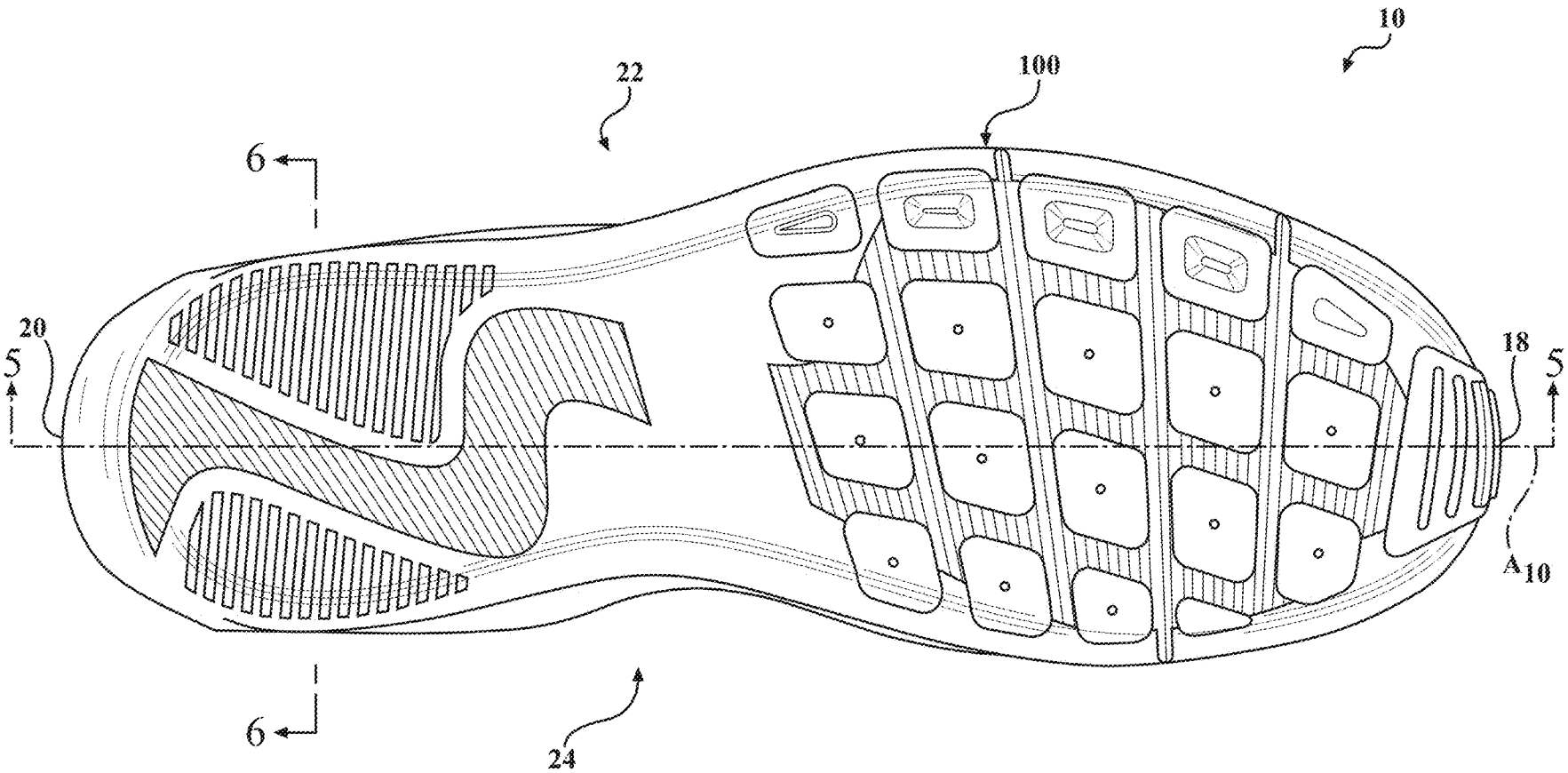
FIG. 4 is a bottom plan view of the article of footwear of FIG. 1.

Referring to FIGS. 1-6, an article of footwear 10 includes a sole structure 100 and an upper 200 attached to the sole structure 100. The article of footwear 10 may be divided into one or more regions. The regions may include a forefoot region 12, a mid-foot region 14, and a heel region 16. The mid-foot region 14 may correspond with an arch area of the foot, and the heel region 16 may correspond with rear portions of the foot, including a calcaneus bone. The footwear 10 may further include an anterior end 18 associated with a forward-most point of the forefoot region 12, and a posterior end 20 corresponding to a rearward-most point of the heel region 16. A longitudinal axis $A_{10}$ of the footwear 10 extends along a length of the footwear 10 from the anterior end 18 to the posterior end 20, and generally divides the footwear 10 into a medial side 22 and a lateral side 24, as shown in FIG. 3. Accordingly, the medial side 22 and the lateral side 24 respectively correspond with opposite sides of the footwear 10 and extend through the regions 12, 14, 16.

With reference to FIG. 2, the sole structure 100 includes a bladder 102 and a cushioning element 104 within which the bladder 102 is disposed. Accordingly, the bladder 102 and the cushioning element 104 cooperate to define a footbed for supporting the upper 200. Particularly, the bladder 102 is disposed within the heel region 16 of the cushioning element 104 to provide the heel region 16 of the sole structure 100 with different cushioning characteristics than the forefoot region 12 and the mid-foot region 14.

Figure 5:
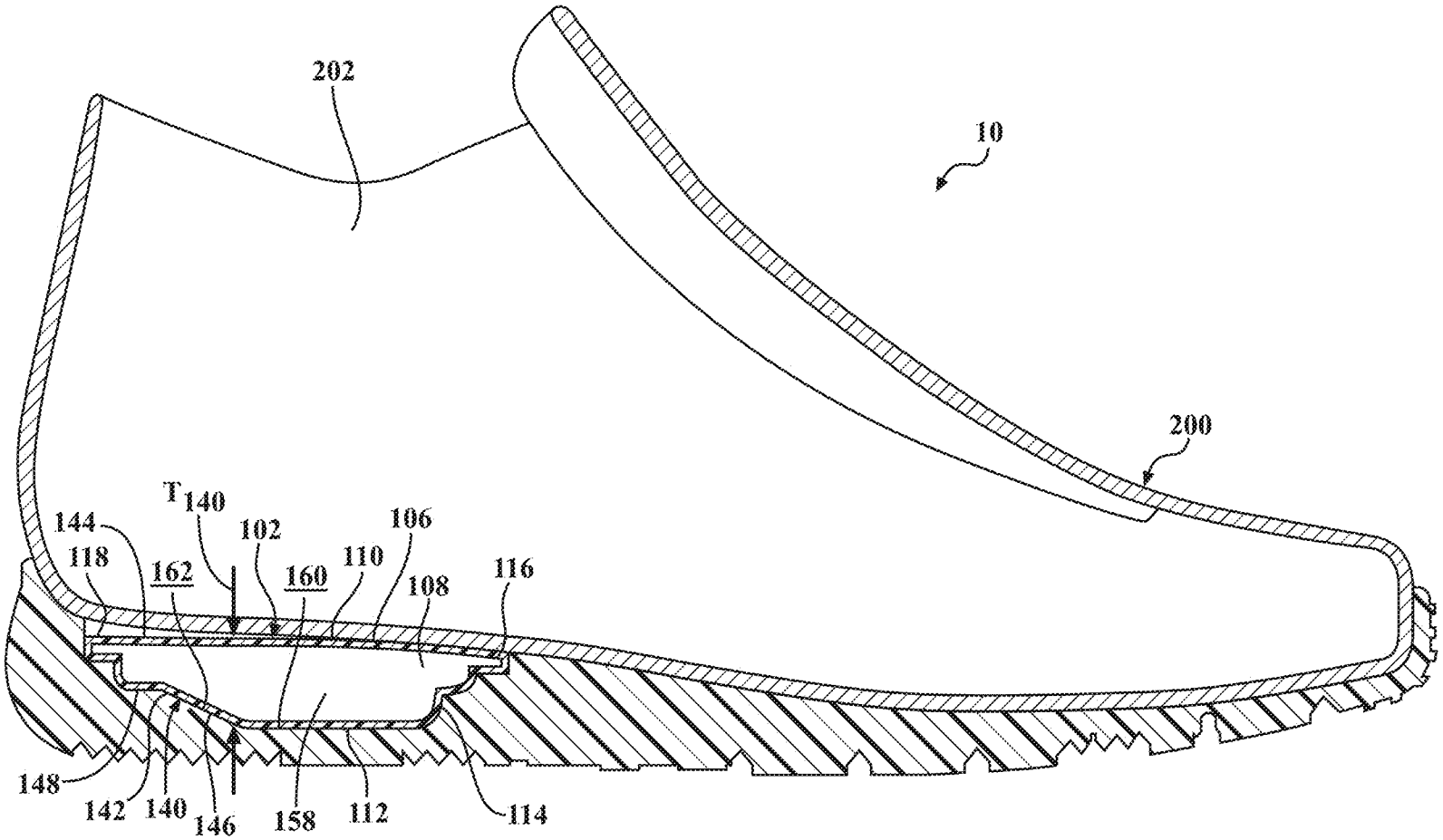
FIG. 5 is a cross-sectional view taken along line 5-5 of FIG. 4.
Figure 6:
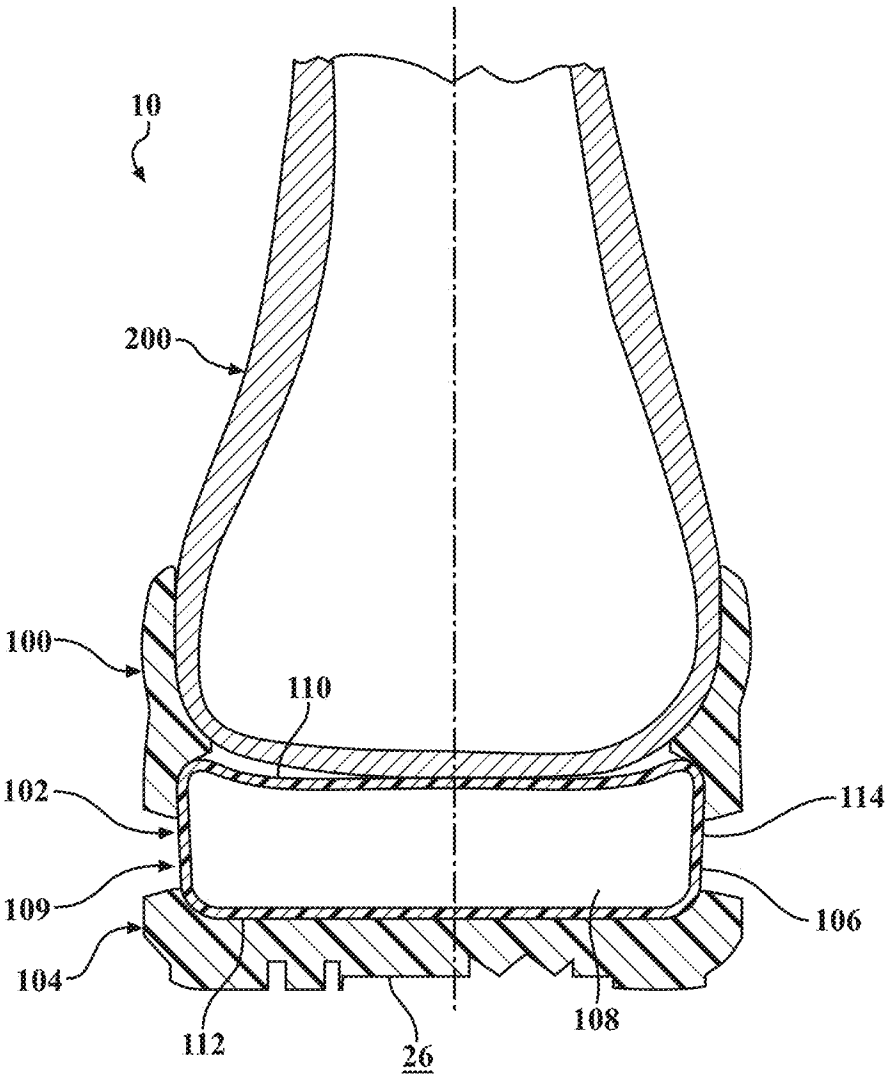
FIG. 6 is a cross-sectional view taken along line 6-6 of FIG. 4.

As shown in the cross-sectional views of FIGS. 5 and 6, the bladder 102 may be formed by a barrier layer 106, which can be joined at discrete locations to define a geometry of the bladder 102. As used herein, the term "barrier layer" (e.g., barrier layer 106) encompasses both monolayer and multilayer films. In some embodiments, the barrier layer 106 is produced (e.g., thermoformed or blow molded) from a monolayer film (a single layer). In other embodiments, the barrier layer 106 is produced (e.g., thermoformed or blow molded) from a multilayer film (multiple sublayers). In either aspect, the barrier layer 106 can have a film thickness ranging from about 0.2 micrometers to about be about 1 millimeter. In further embodiments, the film thickness for the barrier layer 106 can range from about 0.5 micrometers to about 500 micrometers. In yet further embodiments, the film thickness for the barrier layer 106 can range from about 1 micrometer to about 100 micrometers.

The barrier layer 106 can be transparent, translucent, and/or opaque. As used herein, the term "transparent" for a barrier layer and/or a fluid-filled chamber means that light passes through the barrier layer in substantially straight lines and a viewer can see through the barrier layer. In comparison, for an opaque barrier layer, light does not pass through the barrier layer and one cannot see clearly through the barrier layer at all. A translucent barrier layer falls between a transparent barrier layer and an opaque barrier layer, in that light passes through a translucent layer but some of the light is scattered so that a viewer cannot see clearly through the layer.

The barrier layer 106 can be produced from an elastomeric material that includes one or more thermoplastic polymers and/or one or more cross-linkable polymers. In an aspect, the elastomeric material can include one or more thermoplastic elastomeric materials, such as one or more thermoplastic polyurethane (TPU) copolymers, one or more ethylene-vinyl alcohol (EVOH) copolymers, and the like.

As used herein, "polyurethane" refers to a copolymer (including oligomers) that contains a urethane group (—N(C═O)O—). These polyurethanes can contain additional groups such as ester, ether, urea, allophanate, biuret, carbodiimide, oxazolidinyl, isocynaurate, uretdione, carbonate, and the like, in addition to urethane groups. In an aspect, one or more of the polyurethanes can be produced by polymerizing one or more isocyanates with one or more polyols to produce copolymer chains having (—N(C═O)O—) linkages.

Examples of suitable isocyanates for producing the polyurethane copolymer chains include diisocyanates, such as aromatic diisocyanates, aliphatic diisocyanates, and combinations thereof. Examples of suitable aromatic diisocyanates include toluene diisocyanate (TDI), TDI adducts with trimethyloylpropane (TMP), methylene diphenyl diisocyanate (MDI), xylene diisocyanate (XDI), tetramethylxylylene diisocyanate (TMXDI), hydrogenated xylene diisocyanate (HXDI), naphthalene 1,5-diisocyanate (NDI), 1,5-tetrahydronaphthalene diisocyanate, para-phenylene diisocyanate (PPDI), 3,3'-dimethyldiphenyl-4,4'-diisocyanate (DDDI), 4,4'-dibenzyl diisocyanate (DBDI), 4-chloro-1,3-phenylene diisocyanate, and combinations thereof. In some embodiments, the copolymer chains are substantially free of aromatic groups.

In particular aspects, the polyurethane polymer chains are produced from diisocynates including HMDI, TDI, MDI, H12 aliphatics, and combinations thereof. In an aspect, the thermoplastic TPU can include polyester-based TPU, polyether-based TPU, polycaprolactone-based TPU, polycarbonate-based TPU, polysiloxane-based TPU, or combinations thereof.

In another aspect, the polymeric layer can be formed of one or more of the following: EVOH copolymers, poly (vinyl chloride), polyvinylidene polymers and copolymers (e.g., polyvinylidene chloride), polyamides (e.g., amorphous polyamides), amide-based copolymers, acrylonitrile polymers (e.g., acrylonitrile-methyl acrylate copolymers), polyethylene terephthalate, polyether imides, polyacrylic imides, and other polymeric materials known to have relatively low gas transmission rates. Blends of these materials, as well as with the TPU copolymers described herein and optionally including combinations of polyimides and crystalline polymers, are also suitable.

The barrier layer 106 may include two or more sublayers (multilayer film) such as shown in Mitchell et al., U.S. Pat. No. 5,713,141 and Mitchell et al., U.S. Pat. No. 5,952,065, the disclosures of which are incorporated by reference in their entireties. In embodiments where the barrier layer 106 includes two or more sublayers, examples of suitable multilayer films include microlayer films, such as those disclosed in Bonk et al., U.S. Pat. No. 6,582,786, which is incorporated by reference in its entirety. In further embodiments, the barrier layer 106 may include alternating sublayers of one or more TPU copolymer materials and one or more EVOH copolymer materials, where the total number of sublayers in the barrier layer 106 includes at least four (4) sublayers, at least ten (10) sublayers, at least twenty (20) sublayers, at least forty (40) sublayers, and/or at least sixty (60) sublayers.

The bladder 102 can be produced from the barrier layer 106 using any suitable technique, such as thermoforming (e.g. vacuum thermoforming), blow molding, extrusion, injection molding, vacuum molding, rotary molding, transfer molding, pressure forming, heat sealing, casting, low-pressure casting, spin casting, reaction injection molding, radio frequency (RF) welding, and the like. In an aspect, the barrier layer 106 can be produced by co-extrusion followed by vacuum thermoforming to form the profile of the bladder 102, which can optionally include one or more valves (e.g., one way valves) that allow the bladder 102 to be filled with the fluid (e.g., gas).

The bladder 102 desirably has a low gas transmission rate to preserve its retained gas pressure. In some embodiments, the bladder 102 has a gas transmission rate for nitrogen gas that is at least about ten (10) times lower than a nitrogen gas transmission rate for a butyl rubber layer of substantially the same dimensions. In an aspect, bladder 102 has a nitrogen gas transmission rate of 15 cubic-centimeter/square-meter·atmosphere·day ($cm^3/m^2 \cdot atm \cdot day$) or less for an average film thickness of 500 micrometers (based on thicknesses of barrier layer 106). In further aspects, the transmission rate is 10 $cm^3/m^2 \cdot atm \cdot day$ or less, 5 $cm^3/m^2 \cdot atm \cdot day$ or less, or 1 $cm^3/m^2 \cdot atm \cdot day$ or less.

In the illustrated example, the barrier layer 106 encloses an interior void 108 of the bladder 102. The interior void 108 can be provided in a fluid-filled or in an unfilled state. The interior void 108 can be filled to include any suitable fluid, such as a gas or liquid. In an aspect, the gas can include air, nitrogen ($N_2$), or any other suitable gas. The fluid provided to the interior void 108 can be at atmospheric pressure such that the bladder 102 is not pressurized but, rather, simply contains a volume of the fluid at atmospheric pressure. In other aspects, the interior void 108 can alternatively include other compressible media, such as pellets, beads, ground recycled material, and the like (e.g., foamed beads and/or rubber beads).

With reference to FIGS. 5-12, the bladder 102 includes a support chamber 109 configured to provide cushioning to the heel of a foot. The support chamber 109 includes a top wall 110, a bottom wall 112 formed on an opposite side of the bladder 102 from the top wall 110, and a peripheral wall 114 extending from the top wall 110 to the bottom wall 112 and defining an outer peripheral profile of the bladder 102. The support chamber 109 may be further described as extending along a longitudinal axis $A_{109}$ from an anterior end 116 to a posterior end 118 formed at an opposite end from the anterior end 116. A medial side 120 extends from the anterior end 116 to the posterior end 118 on a first side of the support chamber 109 and a lateral side 122 extends from the anterior end 116 to the posterior end 118 on an opposite side of the support chamber 109 from the medial side 120.

As shown, the bottom wall 112 of the support chamber 109 is substantially planar from the anterior end 116 to the posterior end 118 and from the medial side 120 to the lateral side 122, thereby providing a bottom portion of the bladder 102 with a planar support surface. The top wall 110, however, may have a substantially planar interior portion and curve away from the bottom wall 112 adjacent to each of the medial side 120 and the lateral side 122. Thus, the top wall 110 defines a slight recess 123 that extends continuously from the anterior end 116 to the posterior end 118 for receiving a heel portion of the foot.

Figure 8:
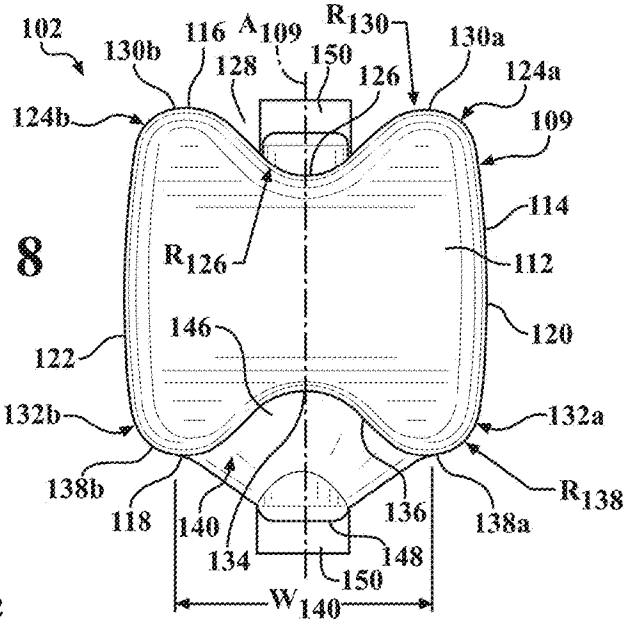
FIG. 8 is a bottom plan view of the bladder of FIG. 7.
Figure 10:
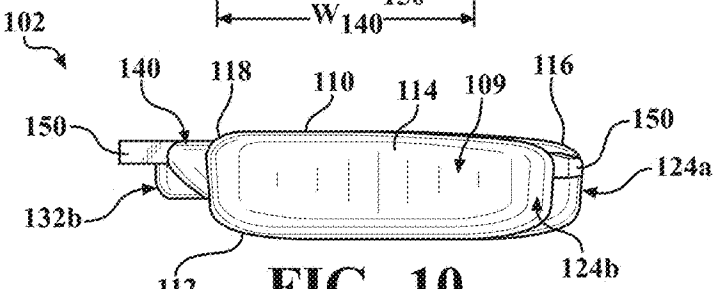
FIG. 10 is a medial side perspective view of the bladder of FIG. 7.
Figure 12:
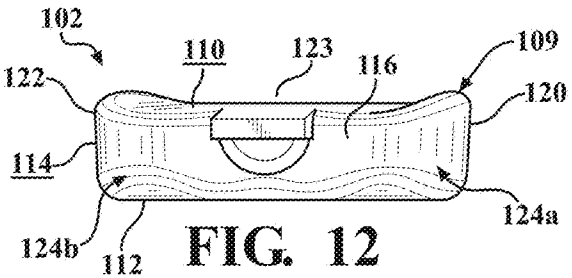
FIG. 12 is an anterior perspective view of the bladder of FIG. 7.
Figure 7:
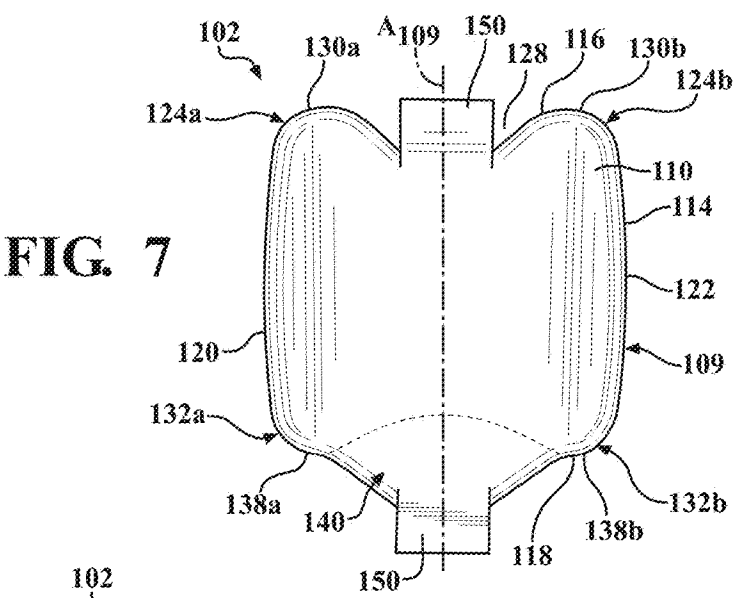
FIG. 7 is a top plan view of a bladder of the article of footwear of FIG. 1.
Figure 9:
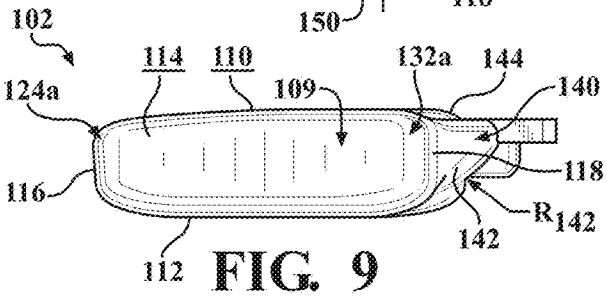
FIG. 9 is a lateral side perspective view of the bladder of FIG. 7.

As shown in FIGS. 7 and 8, the anterior end 116 of the support chamber 109 includes a pair of anterior lobes 124*a*, 124*b* extending from the top wall 110 to the bottom wall 112 on opposite sides of the longitudinal axis $A_{102}$. Particularly, the anterior lobes 124*a*, 124*b* include a medial anterior lobe 124*a* formed at the anterior end 116 adjacent to the medial side 120 of the bladder 102 and a lateral anterior lobe 124*b* formed at the anterior end 116 adjacent to the lateral side 122 of the bladder 102. Generally, the lobes 124*a*, 124*b* respectively form a protruding portion of the bladder 102 at the medial and lateral sides 120, 122 of the support chamber 109, while a central portion 126 (i.e., adjacent to the longitudinal axis $A_{102}$) of the anterior end 116 forms an anterior recess 128 between the anterior lobes 124*a*, 124*b*.

With continued reference to FIGS. 7 and 8, each of the anterior lobes 124*a*, 124*b* protrudes from the anterior end 116 along a direction of the longitudinal axis $A_{109}$ to a respective anterior distal end 130*a*, 130*b* facing outwardly from the bladder 102. When incorporated into the sole structure 100, the anterior distal ends 130*a*, 130*b* face the anterior end 18 of the article of footwear 10. As shown, the anterior distal ends 130*a*, 130*b* are formed by a convex portion of the peripheral wall 114. Here, the peripheral wall 114 is cylindrical and has a radius $R_{130}$ extending from the respective side 120, 122 and around the distal end 130*a*, 130*b* to the central portion 126. In the central portion 126, the peripheral wall 114 is concave and has a second radius $R_{126}$. In some examples, the radius $R_{130}$ of each of the distal ends 130*a*, 130*b* may be the same as the radius $R_{126}$ of the central portion 126. Here, the central portion 126 may also be cylindrical. In some instances, the peripheral wall 114 may include straight transition portions connecting the radius $R_{130}$ of the distal ends 130*a*, 130*b* and the radius $R_{126}$ of the central portion 126.

Referring still to FIGS. 7 and 8, the posterior end 118 of the support chamber 109 includes a pair of posterior lobes 132*a*, 132*b* extending from the top wall 110 to the bottom wall 112 on opposite sides of the longitudinal axis $A_{102}$. Particularly, the posterior lobes 132*a*, 132*b* include a medial posterior lobe 132*a* formed at the posterior end 118 adjacent to the medial side 120 of the support chamber 109 and a lateral posterior lobe 132*b* formed at the posterior end 118 adjacent to the lateral side 122 of the support chamber 109. Generally, the posterior lobes 132*a*, 132*b* respectively form a protruding portion of the support chamber 109 at the medial and lateral sides 120, 122 of the support chamber 109, while a central portion 134 (i.e., adjacent to the longitudinal axis $A_{102}$) of the posterior end 118 forms a posterior recess 136 between the posterior lobes 132*a*, 132*b*.

With continued reference to FIG. 8, each of the posterior lobes 132*a*, 132*b* protrudes from the posterior end 116 along a direction of the longitudinal axis $A_{102}$ to a respective posterior distal end 138*a*, 138*b* facing outwardly from the bladder 102. When incorporated into the sole structure 100, the posterior distal ends 138*a*, 138*b* face the posterior end 20 of the article of footwear 10. As shown, the posterior distal ends 138*a*, 138*b* are formed by a convex portion of the peripheral wall 114. Here, the peripheral wall 114 has a third radius $R_{138}$ extending from the respective sides 120, 122 and around the distal end 130*a*, 130*b* to the central portion 134. In the central portion 134, the peripheral wall 114 is concave and has a fourth radius $R_{134}$. In some examples, the radius $R_{138}$ of each of the distal ends 138*a*, 138*b* may be the same as the radius $R_{134}$ of the central portion 134. In some instances, the peripheral wall 114 may include straight transition portions connecting the radii $R_{138}$ of the posterior distal ends 138*a*, 138*b* and the radius $R_{134}$ of the central portion 134.

The posterior end 118 of the support chamber 109 further includes an expansion chamber 140 formed between the posterior lobes 132*a*, 132*b*. As shown, the expansion chamber 140 may be described as including a lower wall 142 (FIG. 11) extending from the peripheral wall 114 and an upper wall 144 (FIG. 11) extending from the top wall 110. In other words, the lower wall 142 of the expansion chamber 140 is formed by a portion of the barrier layer 106 that projects outwardly from an intermediate portion of the peripheral wall 114 between the top wall 110 and the bottom wall 112, while the upper wall 144 is substantially continuously formed with the top wall 110. Accordingly, the interior void 108 of the bladder 102 extends into the expansion chamber 140, as shown in FIG. 5.

With continued reference to FIG. 8, the expansion chamber 140 extends from a proximal end 146 at the peripheral wall 114 of the support chamber 109, to a distal end 148 formed at an opposite end of the expansion chamber 140 and facing away from the peripheral wall 114. Regardless of the shape of the lower wall 142, a width $W_{140}$ (FIG. 8) and/or a thickness $T_{140}$ (FIG. 5) of the expansion chamber 140 may taper along a direction from the proximal end 146 to the distal end 148.

Figure 11:
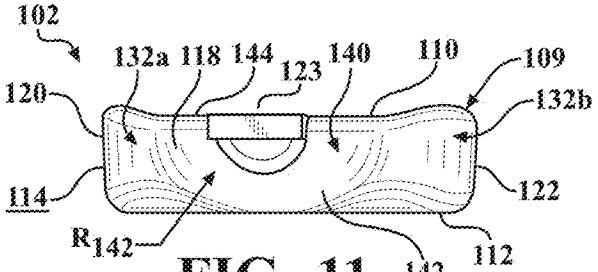
FIG. 11 is a posterior perspective view of the bladder of FIG. 7.

As shown in FIG. 11, the lower wall 142 of the expansion chamber 140 may be curved or cupped, and have a radius $R_{142}$, while the upper wall 144 is substantially flat or planar. In some examples, the lower wall 142 has a semi-spherical curvature, such that the lower wall 142 curves both about and along the longitudinal axis $A_{109}$ of the support chamber 109. As shown, this semi-spherical curvature results in the lower wall 142 curving towards the upper wall 144 along a direction from the proximal end 146 to the distal end 148 and along a direction laterally-outwardly from the longitudinal axis $A_{102}$. In other examples, the lower wall 142 may be substantially straight along the direction of the longitudinal axis $A_{102}$, and curve about the longitudinal axis $A_{102}$ such that the lower wall 142 has a frustoconical shape.

By forming the expansion chamber 140 with a tapering width $W_{140}$ and thickness $T_{140}$, the expansion chamber 140 is configured to accommodate changes in pressure associated with compression of the support chamber 109. For example, in use, the top wall 110 and the bottom wall 112 of the support chamber 109 will be compressed towards each other when the heel of the sole structure strikes a ground surface, thereby compressing the fluid contained within the interior void 108 of the bladder 102. As the compression increases, the fluid applies an outwardly-biasing pressure force to the barrier layer 106 and, more particularly, to the portions of the barrier layer 106 forming the peripheral wall 114 and the expansion chamber 140. The geometry of the expansion chamber 140 dampens the pressure increase by deforming within the cushioning element 104. Particularly, the tapered shape of the expansion provides progressive dampening, whereby the curved lower wall 142 is configured to deform at a desired rate relative to an increase in pressure within the interior void.

Optionally, the bladder 102 may include one or more valves 150 for controlling the pressure of the fluid inserted into the interior void during manufacturing of the bladder 102. In the illustrated example, the bladder includes a first one of the valves 150 extending from the central portion 126 of the peripheral wall 114 at the anterior end 116, and a second of the valves 150 extending from the distal end 148 of the expansion chamber 140. These valves 150 are sealed once manufacturing of the bladder 102 is complete.

Referring now to FIGS. 1 and 2, the cushioning element 104 extends continuously from the anterior end 18 to the posterior end 20 of the article of footwear 10 and forms a ground-engaging surface 26 of the article of footwear 10. As shown in FIG. 2, the cushioning element 104 includes a top surface 152 that defines a portion of a footbed of the article of footwear 10, a bottom surface 154 formed on an opposite side of the cushioning element 104 from the top surface 152 and defining the ground-engaging surface 26, and an outer peripheral side surface 156 extending between the top surface 152 and the bottom surface 154 and defining an outer peripheral profile of the cushioning element 104.

Referring still to FIG. 2, the cushioning element 104 includes a cavity 158 formed in the top surface 152 and configured to receive the bladder 102 therein. The cavity 158 may be described as being defined by a recessed surface 160 that is spaced apart from the top surface 152 to define a depth $D_{158}$ of the cavity 158, and an inner peripheral side surface 162 that extends from the recessed surface 160 to the top surface 152 and defines a peripheral profile of the cavity 158. The depth $D_{158}$ of the cavity 158 corresponds to an overall thickness $T_{102}$ of the bladder 102 such that the top wall 110 of the bladder 102 is flush with the top surface 152 of the cushioning element 104 when the bladder 102 is disposed within the cavity 158. Likewise, as best shown in FIGS. 3 and 5, the peripheral side surface 162 has a profile corresponding to the profile of the peripheral wall 114 and lower wall 142 of the bladder 102, such that the bladder 102 experiences a snug fit within the cavity 158.

Optionally, the cushioning element 104 may include one or more windows 164 extending from the outer peripheral side surface 156 to the inner peripheral side surface 162. As shown, the cushioning element 104 includes a first window 164 on the lateral side of the cavity 158 and a second window 164 on a medial side of the cavity 158, such that the windows 164 provide visibility of the bladder 102 within the cavity 158 when the article of footwear 10 is assembled. In some examples, the windows 164 may be configured to accommodate deformation of the peripheral wall 114 of the bladder 102 when the bladder 102 is compressed.

The cushioning element 104 is formed of a resilient polymeric material, such as foam or rubber, to impart properties of cushioning, responsiveness, and energy distribution to the foot of the wearer. Example resilient polymeric materials for cushioning element 104 may include those based on foaming or molding one or more polymers, such as one or more elastomers (e.g., thermoplastic elastomers (TPE)). The one or more polymers may include aliphatic polymers, aromatic polymers, or mixtures of both; and may include homopolymers, copolymers (including terpolymers), or mixtures of both.

In some aspects, the one or more polymers may include olefinic homopolymers, olefinic copolymers, or blends thereof. Examples of olefinic polymers include polyethylene, polypropylene, and combinations thereof. In other aspects, the one or more polymers may include one or more ethylene copolymers, such as, ethylene-vinyl acetate (EVA) copolymers, EVOH copolymers, ethylene-ethyl acrylate copolymers, ethylene-unsaturated mono-fatty acid copolymers, and combinations thereof.

In further aspects, the one or more polymers may include one or more polyacrylates, such as polyacrylic acid, esters of polyacrylic acid, polyacrylonitrile, polyacrylic acetate, polymethyl acrylate, polyethyl acrylate, polybutyl acrylate, polymethyl methacrylate, and polyvinyl acetate; including derivatives thereof, copolymers thereof, and any combinations thereof.

In yet further aspects, the one or more polymers may include one or more ionomeric polymers. In these aspects, the ionomeric polymers may include polymers with carboxylic acid functional groups, sulfonic acid functional groups, salts thereof (e.g., sodium, magnesium, potassium, etc.), and/or anhydrides thereof. For instance, the ionomeric polymer(s) may include one or more fatty acid-modified ionomeric polymers, polystyrene sulfonate, ethylene-methacrylic acid copolymers, and combinations thereof.

In further aspects, the one or more polymers may include one or more styrenic block copolymers, such as acrylonitrile butadiene styrene block copolymers, styrene acrylonitrile block copolymers, styrene ethylene butylene styrene block copolymers, styrene ethylene butadiene styrene block copolymers, styrene ethylene propylene styrene block copolymers, styrene butadiene styrene block copolymers, and combinations thereof.

In further aspects, the one or more polymers may include one or more polyamide copolymers (e.g., polyamide-polyether copolymers) and/or one or more polyurethanes (e.g., cross-linked polyurethanes and/or thermoplastic polyurethanes). Examples of suitable polyurethanes include those discussed above for barrier layer 106. Alternatively, the one or more polymers may include one or more natural and/or synthetic rubbers, such as butadiene and isoprene.

When the resilient polymeric material is a foamed polymeric material, the foamed material may be foamed using a physical blowing agent which phase transitions to a gas based on a change in temperature and/or pressure, or a chemical blowing agent which forms a gas when heated above its activation temperature. For example, the chemical blowing agent may be an azo compound such as adodicarbonamide, sodium bicarbonate, and/or an isocyanate.

In some embodiments, the foamed polymeric material may be a crosslinked foamed material. In these embodiments, a peroxide-based crosslinking agent such as dicumyl peroxide may be used. Furthermore, the foamed polymeric material may include one or more fillers such as pigments, modified or natural clays, modified or unmodified synthetic clays, talc glass fiber, powdered glass, modified or natural silica, calcium carbonate, mica, paper, wood chips, and the like.

The resilient polymeric material may be formed using a molding process. In one example, when the resilient polymeric material is a molded elastomer, the uncured elastomer (e.g., rubber) may be mixed in a Banbury mixer with an optional filler and a curing package such as a sulfur-based or peroxide-based curing package, calendared, formed into shape, placed in a mold, and vulcanized.

In another example, when the resilient polymeric material is a foamed material, the material may be foamed during a molding process, such as an injection molding process. A thermoplastic polymeric material may be melted in the barrel of an injection molding system and combined with a physical or chemical blowing agent and optionally a crosslinking agent, and then injected into a mold under conditions which activate the blowing agent, forming a molded foam.

Optionally, when the resilient polymeric material is a foamed material, the foamed material may be a compression molded foam. Compression molding may be used to alter the physical properties (e.g., density, stiffness and/or durometer) of a foam, or to alter the physical appearance of the foam (e.g., to fuse two or more pieces of foam, to shape the foam, etc.), or both.

The compression molding process desirably starts by forming one or more foam preforms, such as by injection molding and foaming a polymeric material, by forming foamed particles or beads, by cutting foamed sheet stock, and the like. The compression molded foam may then be made by placing the one or more preforms formed of foamed polymeric material(s) in a compression mold, and applying sufficient pressure to the one or more preforms to compress the one or more preforms in a closed mold. Once the mold is closed, sufficient heat and/or pressure is applied to the one or more preforms in the closed mold for a sufficient duration of time to alter the preform(s) by forming a skin on the outer surface of the compression molded foam, fuse individual foam particles to each other, permanently increase the density of the foam(s), or any combination thereof. Following the heating and/or application of pressure, the mold is opened and the molded foam article is removed from the mold.

Referring now to FIG. 1, the upper 200 is attached to the sole structure 100 and includes interior surfaces that define an interior void 202 configured to receive and secure a foot for support on the sole structure 100. The upper 200 may be formed from one or more materials that are stitched or adhesively bonded together to form the interior void 202. Suitable materials of the upper may include, but are not limited to, mesh, textiles, foam, leather, and synthetic leather. The materials may be selected and located to impart properties of durability, air-permeability, wear-resistance, flexibility, and comfort.

The following Clauses provide an exemplary configuration for a bladder, a sole structure, and/or an article of footwear described above.

Clause 1: A bladder for an article of footwear, the bladder including a support chamber having a top wall, a bottom wall, and a peripheral wall extending between the top wall and the bottom wall and defining a peripheral profile of the support chamber. An expansion chamber extends from the peripheral wall at a first end of the bladder.

Clause 2: The bladder of Clause 1, wherein the peripheral wall defines an anterior end of the support chamber having one or more lobes extending from the top wall to the bottom wall.

Clause 3: The bladder of any one of the preceding clauses, wherein the one or more lobes includes a first lobe disposed adjacent to a first side of the support chamber and a second lobe disposed adjacent to a second side of the support chamber, the first side being disposed on an opposite side of the support chamber than the second side.

Clause 4: The bladder of Clause 3, wherein peripheral wall defines a recess disposed between the first lobe and the second lobe.

Clause 5: The bladder of any one of the preceding clauses, wherein the peripheral wall defines a posterior end of the support chamber having one or more lobes extending from the top wall to the bottom wall.

Clause 6: The bladder of Clause 5, wherein the one or more lobes includes a third lobe disposed adjacent to a first side of the support chamber and a fourth lobe disposed adjacent to a second side of the support chamber, the first side being disposed on an opposite side of the support chamber than the second side.

Clause 7: The bladder of Clause 6, wherein the expansion chamber is disposed between the third lobe and the fourth lobe.

Clause 8: The bladder of any one of the preceding clauses, wherein the expansion chamber includes a flat upper wall and a curved lower wall.

Clause 9: The bladder of Clause 8, wherein the lower wall projects outwardly from the peripheral wall of the support chamber between the top wall and the bottom wall.

Clause 10: The bladder of Clause 8 or 9, wherein the lower wall is cupped and the top wall is planar.

Clause 11: The bladder of any one of the preceding clauses, wherein the support chamber and the expansion chamber cooperate to define an interior void of the bladder.

Clause 12: The bladder of Clause 11, wherein the interior void is filled with a compressible fluid at atmospheric pressure.

Clause 13: The bladder of any one of the preceding clauses, further comprising one or more valves in fluid communication with the support chamber.

Clause 14: The bladder of any one of the preceding clauses, wherein the top wall defines a recess and the bottom wall is planar.

Clause 15: The bladder of any one of the preceding clauses, wherein a thickness of the expansion chamber tapers along at least one of a width and a length of the expansion chamber.

Clause 16: A bladder for an article of footwear, the bladder including a support chamber defining a first portion of an interior void, the support chamber including a first lobe and a second lobe disposed at a first end. An expansion chamber is disposed between the first lobe and the second lobe at the first end of the support chamber. The expansion chamber defines a second portion of the interior void and is in fluid communication with the first portion, the interior void containing a compressible fluid at a first pressure.

Clause 17: The bladder of Clause 16, wherein the first pressure is atmospheric pressure.

Clause 18: The bladder of any one of Clause 16 or 17, wherein each of the first lobe and the second lobe protrudes from the first end.

Clause 19: The bladder of any one of Clause 16-18, wherein each of the first lobe and the second lobe is rounded.

Clause 20: The bladder of any one of Clause 16-19, wherein each of the first lobe and the second lobe is cylindrical.

Clause 21: The bladder of any one of Clause 16-20, wherein the first end of the support chamber includes a curved central portion disposed between the first lobe and the second lobe.

Clause 22: The bladder of Clause 21, wherein the central portion is cylindrical.

Clause 23: The bladder of Clause 21 or 22, wherein the expansion chamber protrudes from the central portion.

Clause 24: The bladder of any one of Clause 16-23, wherein the support chamber includes planar bottom wall and a top wall disposed on an opposite side of the bladder from the bottom wall, the top wall defining a recess.

Clause 25: The bladder of any one of Clause 16-24, wherein the support chamber includes a third lobe and a fourth lobe disposed at a second end of the support chamber.

Clause 26: The bladder of Clause 25, wherein each of the third lobe and the fourth lobe protrudes from the first end.

Clause 27: The bladder of Clause 25, wherein each of the third lobe and the fourth lobe is rounded.

Clause 28: The bladder of Clause 25, wherein each of the third lobe and the fourth lobe is cylindrical.

Clause 29: The bladder of Clause 16, wherein the first end of the support chamber includes a curved central portion disposed between the first lobe and the second lobe.

Clause 30: The bladder of Clause 16, further comprising one or more valves in fluid communication with the support chamber.

Clause 31: A sole structure for an article of footwear, the sole structure including the bladder of any of the preceding Clauses.

Clause 32: The sole structure of Clause 31, further comprising a cushioning element extending from a first end to a second end and including (i) a top surface, (ii) a bottom surface formed on an opposite side of the cushioning element from the top surface, and (iii) a recess formed in the top surface and configured to receive the bladder therein.

Clause 33: The sole structure of Clause 32, wherein the bladder and the top surface of the cushioning element cooperate to define a footbed of the sole structure.

Clause 34: The sole structure of Clause 32, wherein the cushioning element includes a foam material.

Clause 35: An article of footwear including the sole structure of any of Clauses 31-34.

The foregoing description has been provided for purposes of illustration and description. It is not intended to be exhaustive or to limit the disclosure. Individual elements or features of a particular configuration are generally not limited to that particular configuration, but, where applicable, are interchangeable and can be used in a selected configuration, even if not specifically shown or described. The same may also be varied in many ways. Such variations are not to be regarded as a departure from the disclosure, and all such modifications are intended to be included within the scope of the disclosure.

What is claimed is:

1. A fluid-filled chamber for an article of footwear, the fluid-filled chamber comprising:

a first lobe and a second lobe located at an anterior end of the fluid-filled chamber and being separated by a first concave recess;

a third lobe and a fourth lobe located at a posterior end of the fluid-filled chamber and being separated by a second concave recess, the first concave recess and the second concave recess extending in a direction toward one another along a longitudinal axis of the fluid-filled chamber;

a peripheral wall including a planar medial side and a planar lateral side, each of the planar medial side and the planar lateral side extending continuously between the anterior end of the fluid-filled chamber and the posterior end of the fluid-filled chamber, the peripheral wall forming the first concave recess and the second concave recess; and an expansion chamber including a flat upper wall and a curved lower wall.

2. The fluid-filled chamber of claim 1, wherein the expansion chamber extends from one of the first concave recess and the second concave recess.

3. The fluid-filled chamber of claim 1, wherein the first lobe and the third lobe extend along one of a medial side of the fluid-filled chamber and a lateral side of the fluid-filled chamber.

4. The fluid-filled chamber of claim 3, wherein the second lobe and the fourth lobe extend along the other of the medial side of the fluid-filled chamber and the lateral side of the fluid-filled chamber.

5. The fluid-filled chamber of claim 1, wherein the first concave recess and the second concave recess are aligned with one another in a direction substantially parallel to the longitudinal axis of the fluid-filled chamber.

6. The fluid-filled chamber of claim 1, wherein the first lobe and the third lobe are aligned with one another in a direction substantially parallel to the longitudinal axis of the fluid- filled chamber.

7. The fluid-filled chamber of claim 1, wherein the second lobe and the fourth lobe are aligned with one another in a direction substantially parallel to the longitudinal axis of the fluid-filled chamber.

8. The fluid-filled chamber of claim 1, wherein the fluid-filled chamber defines an interior void.

9. The fluid-filled chamber of claim 8, wherein the interior void is at atmospheric pressure.

10. An article of footwear incorporating the fluid-filled chamber of claim 1.

11. A fluid-filled chamber for an article of footwear, the fluid-filled chamber comprising:

a first lobe and a second lobe located at an anterior end of the fluid-filled chamber and being separated by a first concave recess;

a third lobe and a fourth lobe located at a posterior end of the fluid-filled chamber and being separated by a second concave recess, the third lobe being aligned with and extending away from the first lobe along one of a medial side of the fluid-filled chamber and a lateral side of the fluid-filled chamber and the fourth lobe being aligned with and extending away from the second lobe along the other of the medial side of the fluid-filled chamber and the lateral side of the fluid-filled chamber;

a peripheral wall forming a planar side, the planar side extending continuously between the anterior end of the fluid-filled chamber and the posterior end of the fluid-filled chamber and forming the first concave recess and the second concave recess, the first concave recess and the second concave recess extending in a direction toward one another along a longitudinal axis of the fluid-filled chamber;

and an expansion chamber including a flat upper wall and a curved lower wall.

12. The fluid-filled chamber of claim 11, wherein the expansion chamber extends from one of the anterior end and the posterior end.

13. The fluid-filled chamber of Claim 11, wherein the expansion chamber extends from one of the first concave recess and the second concave recess.

14. The fluid-filled chamber of claim 13, wherein the first concave recess and the second concave recess are aligned with one another along a longitudinal axis of the fluid- filled chamber.

15. The fluid-filled chamber of claim 12, wherein the fluid-filled chamber defines an interior void.

16. An article of footwear incorporating the fluid-filled chamber of claim 11.

* * * * *